US005928093A

United States Patent [19]

Lai

[11] Patent Number: 5,928,093

[45] Date of Patent: Jul. 27, 1999

[54] SOCCER KICKING AND SOCCER PLAYING PRACTICE SYSTEM

[76] Inventor: Kong Thomas Lai, Rm. 23, 2/F. Fu Tao Bldg. No. 98 Argyle St., Kowloon, The Hong Kong Special Administrative Region of the People's Republic of China

[21] Appl. No.: 08/901,333

[22] Filed: Jul. 28, 1997

[51] Int. Cl.[6] ..... A63B 63/00; A63B 69/00

[52] U.S. Cl. ..... 473/430; 473/446; 473/471

[58] Field of Search ..... 473/446, 430, 473/470, 471, 441, FOR 212; 434/251; 482/87; 273/108.1

[56] References Cited

U.S. PATENT DOCUMENTS

| | | | |
|---|---|---|---|
| D. 321,370 | 11/1991 | Curtis . | |
| 2,909,370 | 12/1959 | Fortney . | |
| 2,974,958 | 3/1961 | O'Herron . | |
| 3,387,842 | 6/1968 | Edgar . | |
| 3,424,458 | 1/1969 | Hopps | 473/443 |
| 3,637,210 | 1/1972 | Brantley | 473/443 |
| 3,856,298 | 12/1974 | Frantti | 473/446 |
| 3,861,676 | 1/1975 | Paul . | |
| 4,529,390 | 7/1985 | Levy et al. . | |
| 4,869,503 | 9/1989 | Grasso | 473/444 |
| 4,934,938 | 6/1990 | Orlandi et al. . | |
| 4,989,862 | 2/1991 | Curtis . | |
| 5,048,822 | 9/1991 | Murphy . | |
| 5,181,725 | 1/1993 | Leras et al. . | |
| 5,503,402 | 4/1996 | Moss, Jr. . | |
| 5,527,185 | 6/1996 | Davis . | |
| 5,611,761 | 3/1997 | Brown . | |

FOREIGN PATENT DOCUMENTS

| | | | |
|---|---|---|---|
| 667753 | 6/1929 | France | 473/FOR 212 |
| 689829 | 4/1965 | Italy | 473/FOR 212 |

OTHER PUBLICATIONS

"Sports Illustrated", magazine, article for Reader's Digest Football, pp. 22–24, Jul. 20, 1987.

*Primary Examiner*—Sebastiano Passaniti

*Attorney, Agent, or Firm*—Jacobson, Price, Holman & Stern, PLLC

[57] ABSTRACT

A practice area for children to sharpen their soccer skills, preferably taking place in an indoor arena or recreation room. A soccer goalkeeper is positioned in an aesthetically pleasing and inviting environment which will entice children to participate. For example, a castle can be erected having an entranceway to the castle which is actually a practice soccer goal. The goal may be varied in shape and size with varied net structures. A goalkeeper is positionable in front of a goal of the castle in an infinite number of positions. The arms, legs and torso of the simulated goalkeeper, in the form of a mannequin or a remotely controlled robot, can be varied in position so as to present various defensive postures. Once positioned, the soccer goalkeeper will maintain this position until manually repositioned or electrically manipulated to occupy a different position.

17 Claims, 10 Drawing Sheets

SOCCER KICKING AND SOCCER PLAYING PRACTICE SYSTEM

FIELD OF THE INVENTION

The present invention relates to a system for encouraging young children to practice soccer kicking and soccer playing against a poseable goalkeeper movably positioned in front of a soccer goal in an indoor arena.

BACKGROUND OF THE INVENTION

The game of soccer as it is referred to in North America, or association football as it is called in most of the world, is the world's most popular team sport. Almost every country on Earth plays the game in some form or another. It is both physically and intellectually demanding, requiring excellent athletic skill and quick thinking.

Various civilizations take credit for discovering the sport. The first record of soccer-like games acknowledge games having been played in China more than 2,000 years ago. Other records reflect early soccer play in ancient Greece, Japan, and Mexico.

A game known as harpastrum was played by the Romans. This game spread throughout Europe and was probably the origin of modern soccer.

England, however, was the starting place of the modern day game. In 1863 the Football Association (FA) was created and uniform rules were established. In 1872 the first international game was played between England and Scotland. Soccer professionalism was legalized in England in 1885. From there the game spread throughout the British Empire and to the rest of the world.

An international governing body was established in 1904 to control the sport—the Fédération Internationale de Football Association (FIFA). Today, FIFA is headquartered in Z ürich, Switzerland, has more than 140 member nations and oversees the soccer play of about 39 million players worldwide.

FIFA rules require that the game be played on a rectangular soccer field between 100 and 130 yards long and between 50 and 100 yards wide. In international matches the field is 110 to 120 yards long and 70 to 80 yards wide. A goal having a width of 8 yards and a height 8 feet is placed at each end of the field. The touchlines are located on the sides of the field. The goal lines are at the ends of the field. Additional markings include a halfway line, goal areas, penalty areas, corners, and center circle.

There are 11 players on a team consisting of a goalkeeper and ten field players. The field players include defenders (fullbacks), midfielders (halfbacks), and forwards. The uniform of the game includes shorts, a shirt, socks, shoes, soccer goal keeper's gloves, and sometimes shin guards. A soccer ball is a round, inflated rubber bladder covered with leather or other approved material. The ball has a circumference between 27 and 28 inches and a weight between 14 and 16 ounces.

A referee officiates the game. The referee enforces the rules and keeps track of the time. Two linesmen patrol the touchlines and determine possession.

The purpose of the game is to put the ball into the opponent's goal. The field players commonly use their feet, head, or body. Only the goalkeeper can touch the ball with their hands. The field players get into position to score by using a series of passing movements, either by kicking, heading, or dribbling (controlling the ball with the feet) the ball downfield. Players may run as many as 6 or 7 miles during the course of a game. The game is divided into two 45-minute halves, with the team scoring the most goals winning.

The world championship of soccer is known as the World Cup. It is played every four years and is the most-watched sporting event in the world. The World Cup attracts an estimated television audience of more than 1 billion people.

The sport's popularity has grown rapidly in the United States since the 1960's through promotion by groups such as the United States Soccer Federation. In 1968, the North American Soccer League (NASL) was the first professional soccer league to compete in the United States. League play was suspended in 1985.

However, in 1978 the Major Indoor Soccer League (MISL) began professional competition in the United States. Indoor soccer is a faster version of the outdoor game and is played on a smaller field.

Examples of known simulated figures for use in practicing sports are described in U.S. Pat. Nos. 2,909,370, 2,974,958, 3,861,676, 3,387,842, 4,529,390, 4,934,938, 4,989,862, 5,181,725, 5,503,402, 5,527,185, Des. 321,370. All of these patents are hereby incorporated in their entirety by reference.

With reference to the individual patents, U.S. Pat. No. 2,909,370 discloses a boxing dummy. The dummy includes a mechanism by which when the dummy is struck on the head, both of its gloves are moved outwardly and/or upwardly toward the person striking the dummy. In addition, the head and face of the dummy are turned in a sidewise direction oppositely from the direction of a side blow to either side of the dummy's head delivered by an individual, and from which sidewise movement the dummy's head will immediately return to its normal or frontwise position. Similar movement occurs with the body of the dummy when a blow is delivered to either side of a median line on the dummy.

In U.S. Pat. No. 2,974,958 it is disclosed that a miniature golf apparatus and game can be provided which includes a barrier having a tunnel through which a ball may pass and a deflector arranged behind the tunnel for deflecting the ball to either side. The barrier may be in the form of a structure having rubber barriers surrounding the openings such that the ball bounces back if not hit in the correct direction.

In U.S. Pat. No. 3,387,842 it is disclosed that a self defense practice device is used for training in various self defense arts such as karate or judo. The practice dummy includes an electrically operated caming means for vertical oscillation of the dummy. The dummy includes markings to indicate the various nerve centers which are normally present in a human being and which, if struck in a suitably rapid and forceful manner will produce temporary disability, extreme pain, temporary paralysis, or unconsciousness.

In U.S. Pat. No. 3,861,676 it is disclosed it is disclosed that a disconnectable training device can be provided for sports such as jujitsu, judo or karate. The training device is in the shape and size of a human being and includes yieldable material with the arms and the shoulder sections being held by means of joints which can be adjusted. Upon impact from an individual, the body will be disconnected from a support plate.

In U.S. Pat. No. 4,529,390 it is disclosed that an interactive inflatable bag toy can be provided having a pocket for receiving and retaining a thrown object. The sidewalls of the pocket are biased inward by air pressure of the inflated body to constrict a portion of the pocket and facilitate retention of the object.

In U.S. Pat. No. 4,934,938 it is disclosed that a football training dummy can be provided which springs back automatically when struck by a ball.

In U.S. Pat. No. 4,989,862 it is disclosed that a basketball game practice device can be provided to simulate a defensive basketball player which is variable in height according to a particular offensive player's height and needs. In addition, the arms of the defensive device are individually rotatable. Also, the defensive device includes resilient lower limbs and stabilizers affixed thereto so that bumps or contact with the defensive device will not knock down or substantially move the defensive device.

In U.S. Pat. No. 5,181,725 it is disclosed that a soccer shooting training target can be installed on an existing soccer goal. The target includes a plurality of individual targets having flaps sized to allow passage of a soccer ball. This device requires very accurate soccer kicking towards the corners of a soccer goal net for more advanced players.

In U.S. Pat. No. 5,503,402 it is disclosed that a soccer practice focal device is provided to be mounted for quick installation and removal from a soccer goal. The device can thereby by utilized immediately before a soccer game. The focal device defines a focal area which a player mentally focuses on and attempts to shoot a soccer ball through.

In U.S. Pat. No. 5,527,185 it is disclosed that an athletic training device can be provided in the shape of a human athlete which is vertically adjustable in height and having arms articulated at the elbows and shoulders to position the arms. In one embodiment, a soccer goalkeeper is mounted vertically above a base stand with a support rod extending behind the player.

In U.S. Pat. No. Des. 321,370 a simulated basketball player is disclosed.

SUMMARY OF THE INVENTION

The enthusiasm shown by the world in embracing the game of soccer, has had an impact on the world's children. Soccer is an important developemental game whose qualities will enhance desirable qualities in children.

Accordingly, it is an important object of the present invention to provide a practice area for children to sharpen their soccer skills, preferably taking place in an indoor arena. This object will be accomplished by the use of a simulated soccer goalkeeper, male or female, positioned in an aesthetically pleasing and inviting environment which will entice children to participate.

For example, a castle can be erected having an entranceway to the castle which is actually a practice soccer goal. The goal may be varied in shape and size with varied net structures.

A goalkeeper is positionable in front of a goal of a castle or other structural arrangements, such as a three-dimensional block model, are included in the scope of the present invention, in an infinite number of positions. The arms, legs and torso of the simulated goalkeeper, in the form of a mannequin or a remotely controlled robot, can be varied in position so as to present various defensive postures. Once positioned, the soccer goalkeeper will maintain this position until manually repositioned or electrically manipulated to occupy a different position.

Accordingly, children can practice a goal shot against a prepositioned goalkeeper for an extended period of time or by frequently altering the position of the goalkeeper, practicing varied attacks on the goalkeeper over short intervals of time.

It is understood as being within the scope of the present invention that when an "arena" is referred to, it may be a practice arena located indoors in an amusement park, within an auditorium, indoor game hall, sports center or even a recreation room of an apartment or commercial complex. The field forming the arena may include simulated grass and a separate protected area, having chairs and tables, for adults to monitor the progress of their children and maintain statistics of a child's improvement. This area may also be used for consuming food and drink without interfering with the practice field.

In contrast to the cited patents which relate to the use of practice dummies, the present invention includes a system for suspending a simulated goalkeeper from the ceiling of an indoor arena or from the ground, such that the simulated goalkeeper can be maintained in an above ground position such as would be encountered by a diving or jumping goalkeeper during actual soccer play. In addition, rather than intending to contact the practice dummies as in the prior art, it is an object of the present invention to avoid contact by a soccer ball with the simulated soccer goalkeeper of the present invention by kicking the soccer goal around the goalkeeper and into the goal.

Dependent upon the position of the goalkeeper, the child can practice kicking of a soccer ball into a goal which is part of an inviting, aesthetically pleasing structure. Creation of such an environment encourages young children to increase their practice time, and accordingly their skills.

The movability of the simulated soccer goalkeeper is preferably obtained by extending a rigid tube from within a tube holder, located below ground, with a portion of the tube extending up into one foot, or in the case of two tubes, into both feet of the simulated soccer goalkeeper. In addition, the arms, legs and torso of the simulated soccer goalkeeper are poseable into an infinite number of positions which are maintained in place.

Alternatively, the simulated soccer goalkeeper may be supported above ground by a weighted base having a horizontally extending support rod extending between the support base and the player for anchoring a free end of the support rod to the arms, legs or torso of the player. The support rod is positioned within a larger internal diameter tube mounted in the torso of the player.

Another alternative for positioning the simulated soccer goalkeeper is by suspension from an overhead support rod slidably anchored at one end in a guide track suspended from the ceiling or a wall of an indoor arena. The opposite end of the support rod is secured to the torso of the simulated soccer goalkeeper so that the body of the goalkeeper is rotatably mounted on the support rod for suspension of the entire body of the goalkeeper above ground or positioned with at least one foot on the ground and the arms posed in a simulated diving orientation.

Accordingly, it is another object of the present invention to provide a simulated soccer goalkeeper which is positionable in a variety of positions and in all directions so as to simulate the orientation of a soccer goalkeeper attempting to block a soccer goal shot.

It is another object of the present invention to provide a soccer playing practice system including a simulated soccer goalkeeper which is positionable in front of a soccer goal in a variety of positions so as to enable young children to practice soccer goal shots in an indoor arena with a mannequin posing as the goalkeeper in a position to entice children to sharpen their soccer goal shot skills and to monitor their progress by a statistical analysis marking system.

It is still yet another object of the present invention to provide a soccer playing practice system having a simulated soccer goalkeeper which is supported by a rod extending from the ground into one of the feet of the goalkeeper such that the position of the goalkeeper can be manipulated in a position simulative of a soccer goalkeeper's position for blocking soccer goal shots.

It is still yet another object of the present invention to provide a soccer playing practice system where the soccer goalkeeper is suspended from the ceiling or four walls of an arena into a position simulative of an elevated goal protecting position in front of a soccer goal.

It is still yet another object of the present invention to provide a soccer playing practice system included in an indoor arena having a playing field and a soccer goal located within a structural form, such as a castle, wherein children are enticed to practicing kicking soccer goals past a simulated soccer goalkeeper and including a protected area for including adult supervision.

These and other objects of the invention, as well as many of the intended advantages thereof, will become more readily apparent when reference is made to the following description taken in conjunction with the accompanying drawings.

DETAILED DESCRIPTION OF THE PREFERRED EMBODIMENTS

Figure 1:
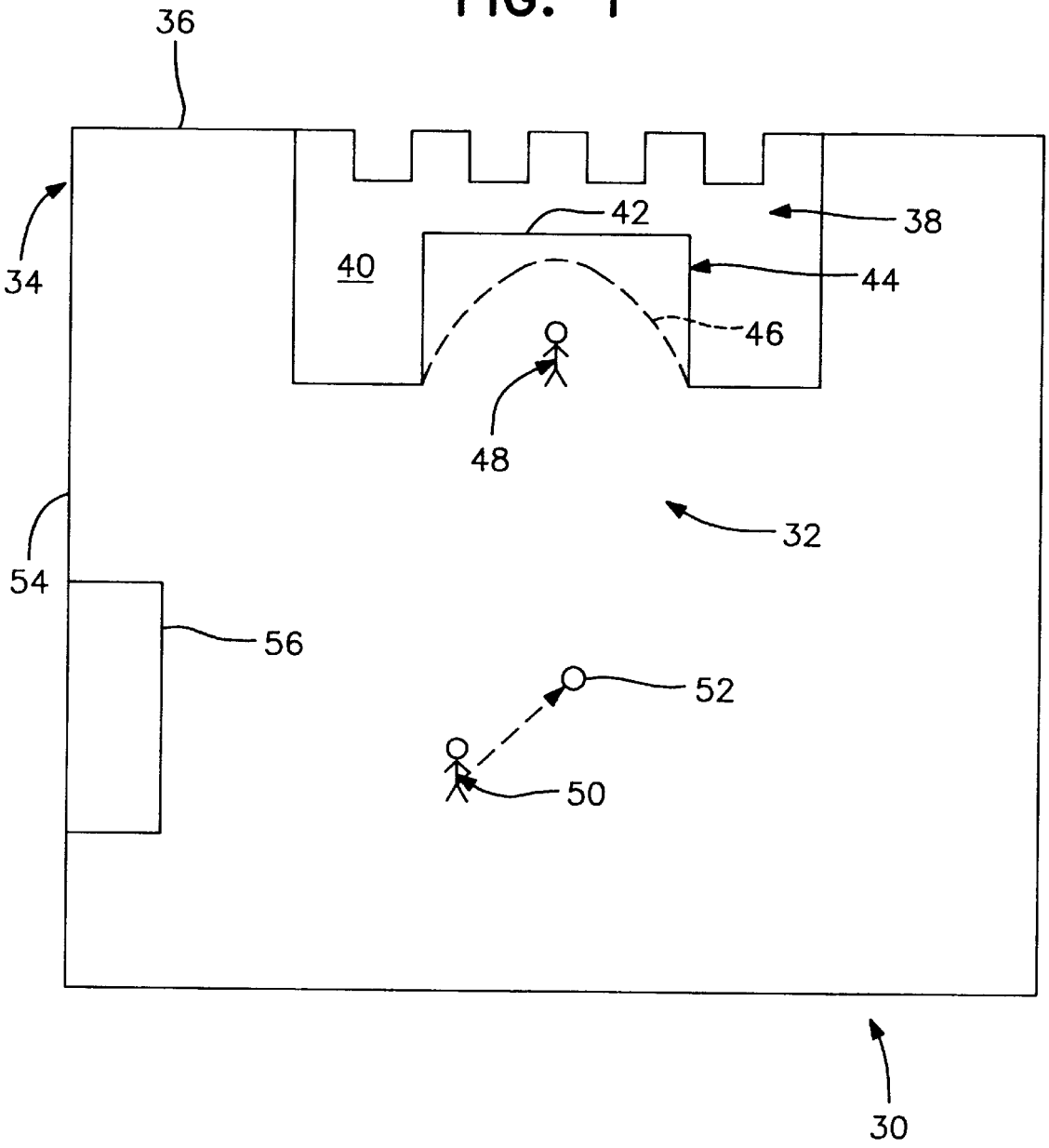
FIG. 1 is a schematic representation of an indoor soccer arena illustrating the system of the present invention and including a soccer field, a simulated castle including an opening which contains a soccer goal, in front of which is positioned a simulated soccer goalkeeper. Positioned on the field is a child practicing soccer goal kicks and to one side of the field is a protected area within which parents and/or supervising adults can be located for encouraging their children and maintaining statistics on the child who is practicing soccer by a marking system.

In describing a preferred embodiment of the invention illustrated in the drawings, specific terminology will be resorted to for the sake of clarity. However, the invention is not intended to be limited to the specific terms so selected, and it is to be understood that each specific term includes all technical equivalents which operate in a similar manner to accomplish a similar purpose.

Figure 2:
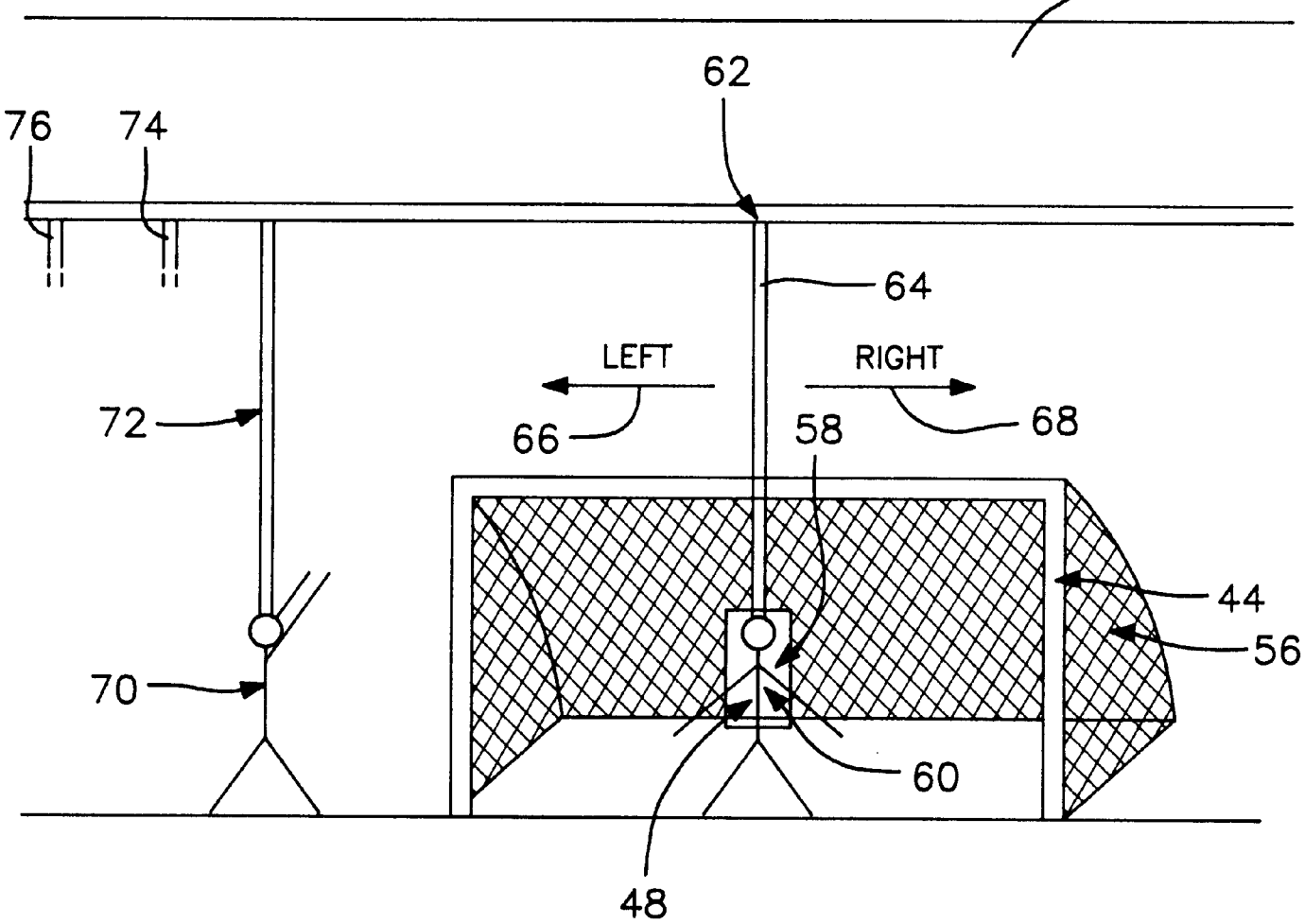
FIG. 2 illustrates one arrangement of the soccer playing practice system of the present invention including a plurality of simulated soccer goalkeepers suspended from a ceiling mounting system and positioned in different soccer goal protecting positions for shifting of the alternate soccer goalkeepers and thereby changing the positioning of the soccer goalkeeper to be used by a child practicing kicking of a goal shot past a goalkeeper.

With reference to the drawings, in general, and to FIGS. 1 and 2, in particular, a soccer playing practice system embodying the teachings of the subject invention is generally designated as 30. With reference to the orientation in FIG. 1, the system 30 includes, preferably, an indoor arena, in which is located a playing field 32 made of natural grass or artificial turf forming a soccer playing field. An entranceway 34 is provided at one end 36 of the field. At the same end 36, is positioned a decorative structure 38. In the embodiment shown, this structure is in the form of a castle 40.

The castle 40, includes an opening 42 which includes a soccer goal 44. Alternatively, the goal can take the form of the goal 46 shown in dotted lines. The goal forms a "kicking zone" for encouraging young children to kick a soccer ball. The size of the goal may be varied to increase the accuracy of the kicker.

Positioned in front of the goal is a simulated soccer goalkeeper 48 which is positionable by movement of its legs, arms, head and torso into an infinite number of forms. The goalkeeper 48 is supported by one of a plurality of support systems which are either based in the ground, suspended from the ceiling or walls or from a support stand positioned on the ground from which extends a support rod. The goal forms a "kicking zone" for encouraging young children to kick a soccer ball. The size of the goal may be varied to increase the accuracy of the kicker.

Positioned downstream from the goalkeeper 48 is an individual 50 who is practicing the game of soccer in an effort to increase their skill and ability. It is an object of the individual to kick a soccer ball 52 past the goalkeeper 48 and into a scoring zone so as to simulate the scoring of a soccer goal. This increases the individual's self-confidence and enjoyment of the game.

Positioned on one side 54 of the field 32 is a protective enclosure 56 within which may be located a plurality of chairs and tables and storage compartments for the shoes of the individuals who are practicing the soccer game. The parents of the individual may be positioned within this enclosure as well as coaches and/or supervising adults. From this vantage point, the efforts of the individual 50 can be statistically monitored.

In FIG. 2, the goalkeeper 48 is shown positioned in front of a soccer goal 44 having a net 56. The goalkeeper 48 is supported by a base support 58 positioned at the rear of the soccer goal 44. An elongated rod 60 extends from the stand 58 and is attachable to the torso of the goalkeeper 48. The weight of the base support 58 maintains the position of the goalkeeper 48 in a predetermined position.

Alternatively, a guide track 62 mounted on the ceiling 64 of the arena may be used to change the location of the goalkeeper 48. In this arrangement, a support rod 64 extends from the guide track 62 and into the torso of the goalkeeper 48. The support rod 64 is movable to the left as indicated by arrow 66 or to the right as indicated by arrow 68.

In addition, located to one side of the goalkeeper 48 is a second simulated soccer goalkeeper 70 which is positioned in a different position from the goalkeeper 48 and supported by support rod 72 extending to the guide track 62. Goalkeeper 70 has both of its arms extending upwardly from one side of the torso as compared to goalkeeper 48 having its arms extending downwardly from its sides.

Similarly, additional support rods 74 and 76 can be supported within guide track 62 and similarly include additional goalkeepers which are positioned in alternative positions to that of goalkeepers 48 and 70. Accordingly, by the sliding movement of the support rods 64, 72, 74 and 76, different positioned goalkeepers can be slid to a position in front of the soccer goal 44.

As an example of the various positions within which a simulated soccer goalkeeper can be positioned, reference is made to FIGS. 3 through 10. It is understood that various support systems can be used to maintain the position of the goalkeepers shown in FIGS. 3 through 10.

Figure 3:
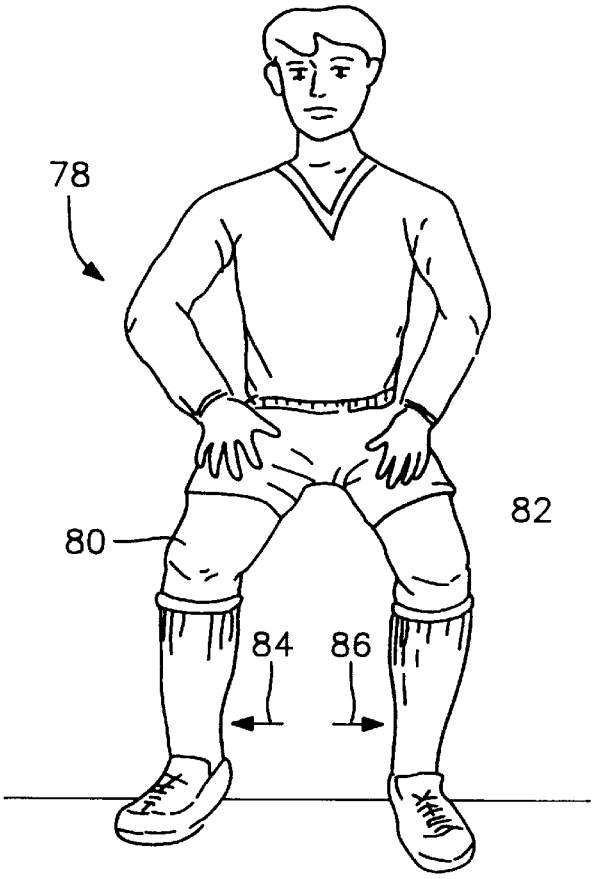
FIG. 3 is a first simulated goalkeeper in a first position.
Figure 4:
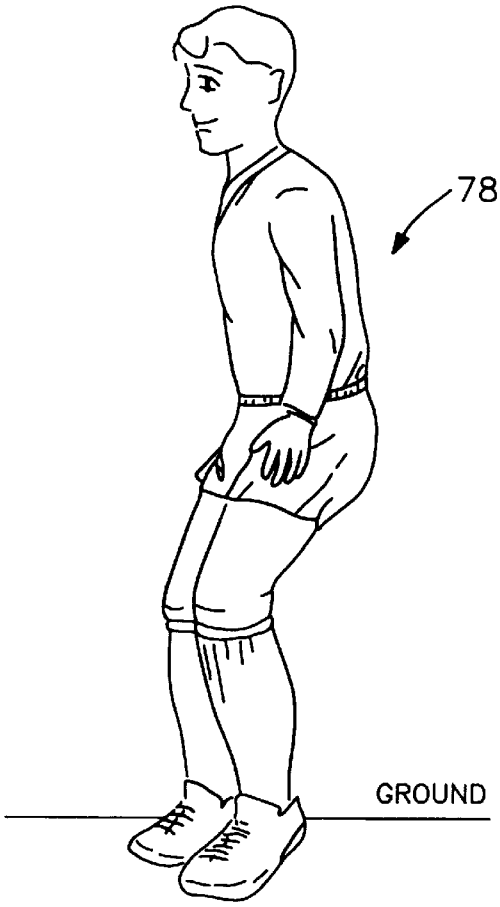
FIG. 4 is a side perspective view of the simulated soccer goalkeeper shown in FIG. 3.

In FIGS. 3 and 4, the goalkeeper 78 is positioned with his legs spaced slightly apart, knees bent, hands on his legs, in the "ready" position. The legs 80, 82, are positionable in the direction of arrows 84 and 86 to simulate the positioning of a soccer goalkeeper for a soccer goal kick. This is just one example of a soccer goalkeeper's positioning in front of a goal for practicing of children in the taking of soccer goal kicks.

Figure 5:
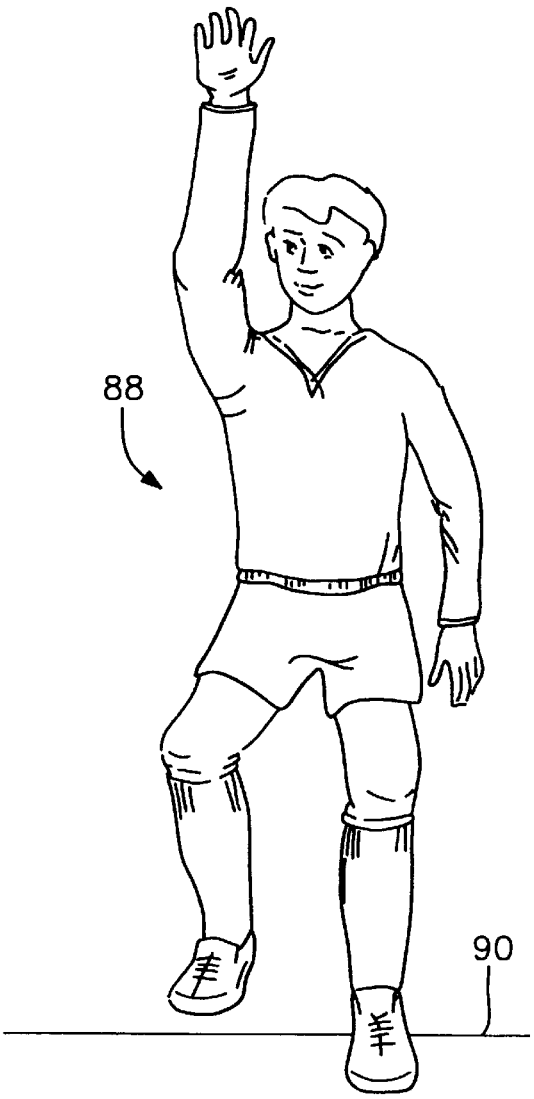
FIG. 5 is a second simulated goalkeeper in an alternate position.
Figure 6:
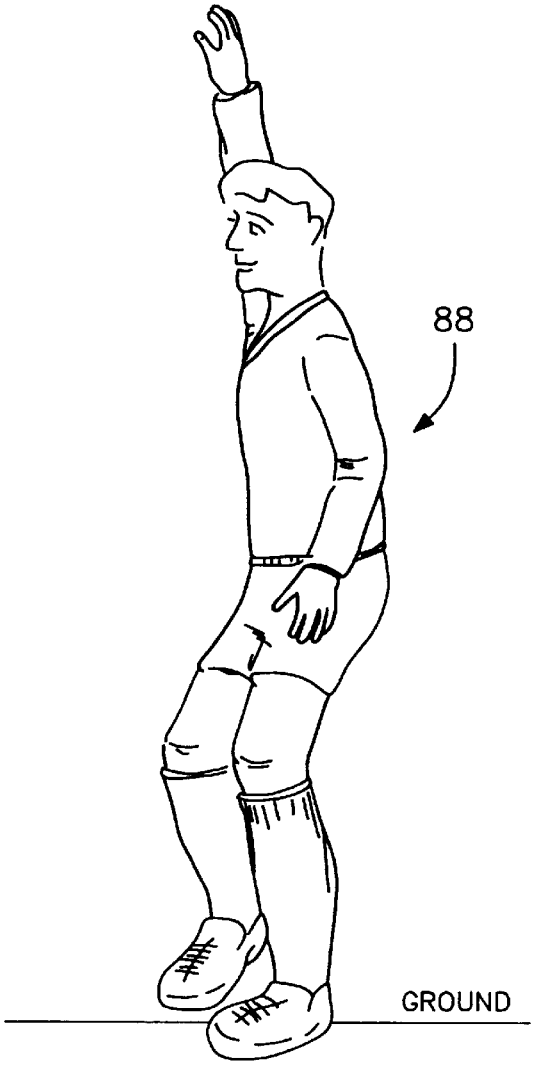
FIG. 6 is a side perspective view of the simulated soccer goalkeeper shown in FIG. 5.

As shown with respect to FIGS. 5 and 6, simulated soccer goalkeeper 88 is positionable with one elevated arm and one arm by his side. In addition, while both legs are slightly bent, one leg is positioned above the ground 90. This position is simulative of a slight jumping of the goalkeeper.

Figure 7:
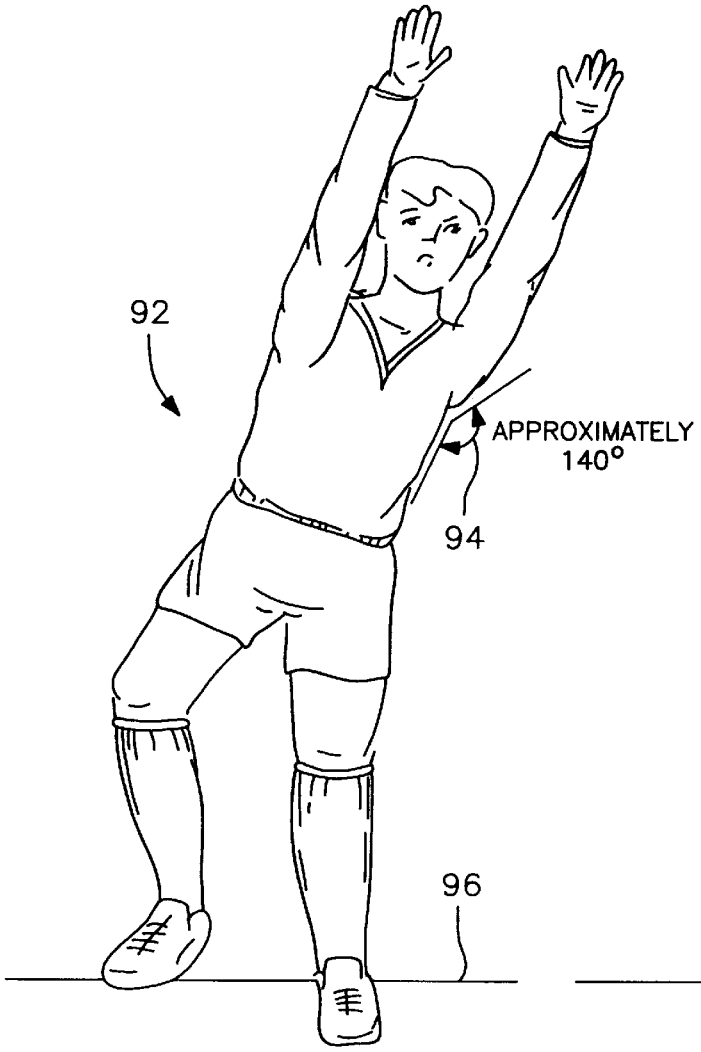
FIG. 7 is a third simulated soccer goalkeeper in an alternate position.
Figure 8:
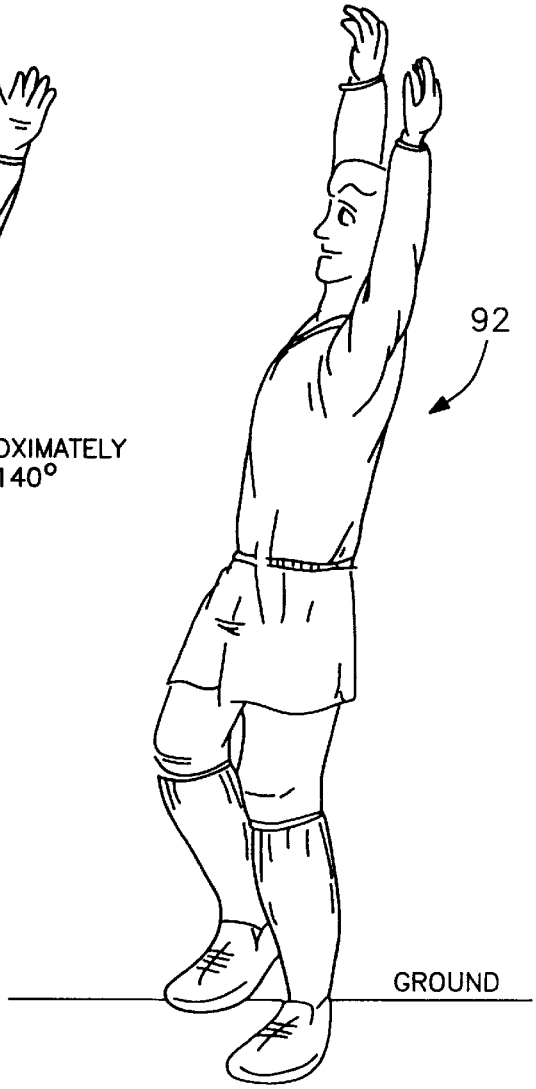
FIG. 8 is a side perspective view of the simulated soccer goalkeeper shown in FIG. 7.

In FIGS. 7 and 8, a goalkeeper 92 is shown in a position with both arms extending above the goalkeeper's head and with the torso bent at an angle 94 of approximately 140°. One leg is positioned on the ground 96 whereas the other leg is slightly lifted above the ground.

Figure 9:
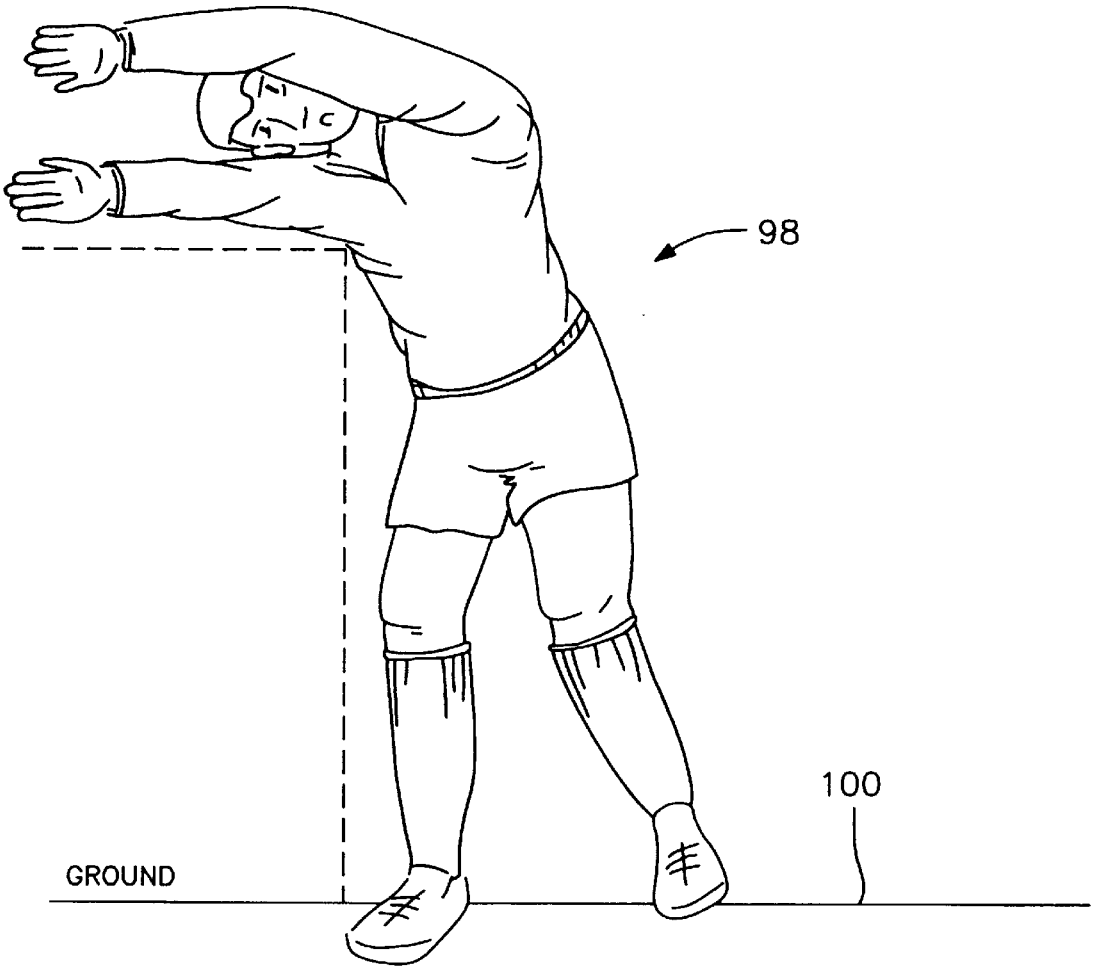
FIG. 9 is a fourth simulated soccer goalkeeper in an alternate position.

In FIG. 9, a goalkeeper 98 is shown in a position simulative of a sudden throwing of the body of the goalkeeper to one side so that his arms extend parallel to the ground 100 at an angle of 90° with respect to his body. The goalkeeper appears to be stretching towards a sudden soccer goal kick directed to the right side of the goalkeeper.

Figure 10:
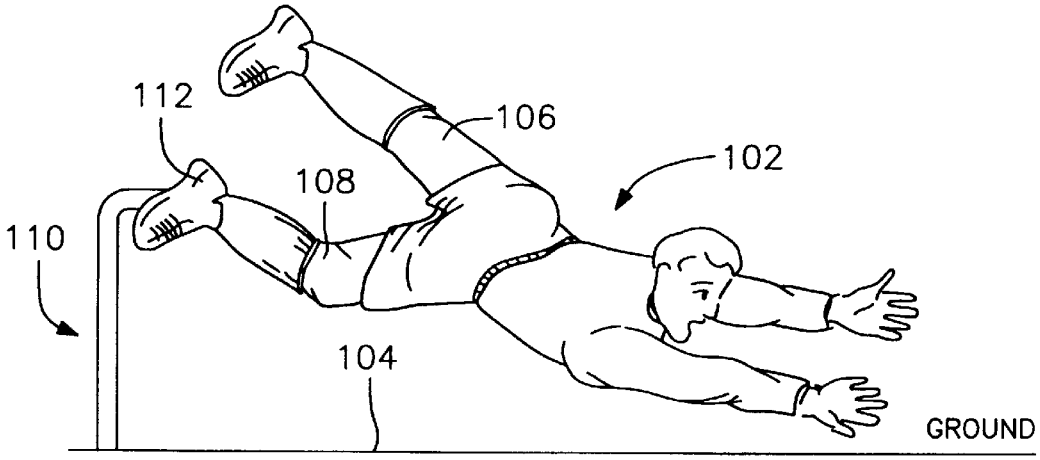
FIG. 10 is a fifth simulated soccer goalkeeper in an alternate position, representative of just five of the infinite positions within which the soccer goalkeeper according to the present invention may be positioned.

In FIG. 10, the simulated soccer goalkeeper 102 is positioned totally above the ground 104. Both legs 106, 108 are positioned to appear as if the goalkeeper is leaping across the front of the goal in an attempt to save a goal. In this position, the arms extend in front of the goalkeeper, approximately parallel to the ground.

As will be noted for this embodiment, an L-shaped support rod 110 extends from the ground 104 and then turns at a right angle to connect with the foot 112 at the bottom of the leg 108 of the goalkeeper. As will be explained in more detail with reference to the other figures, the support rod 110 is housed within a tube located in the ground having a greater diameter than the support rod. In addition, a receiving tube located within the leg 108 of the simulated goalkeeper 102 receives the lesser diameter support rod 110. The position of the goalkeeper 102 can thereby be supported above the ground 104.

Figure 11:
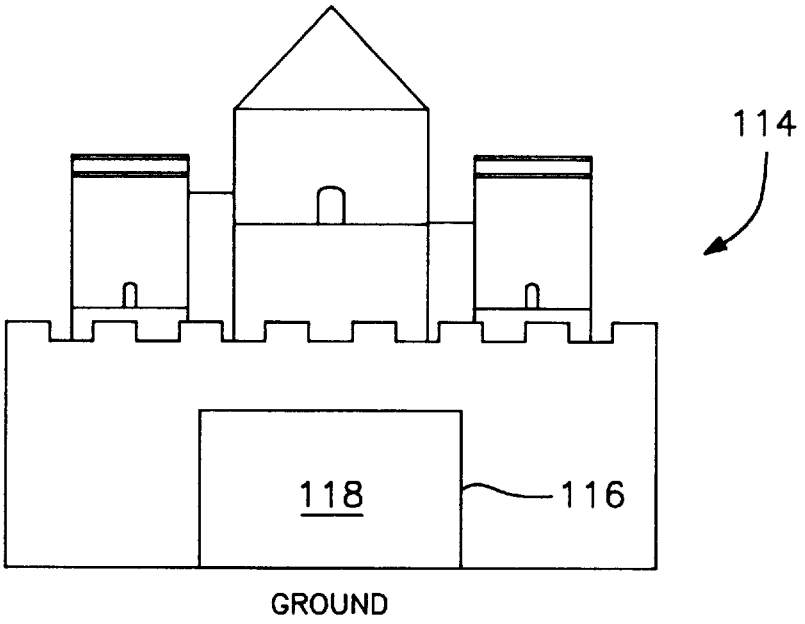
FIG. 11 is a schematic illustration of a structural form, for example, a castle, which may include a soccer goal within an opening of the castle so as to provide an aesthetically pleasing soccer goal to a child who wishes to improve their soccer playing ability.

In FIG. 11, a structural element 114 is shown which is simulative of a castle as shown with respect to decorative structure 38, shown in FIG. 1. In this embodiment, the opening 116 appears to be a doorway or an entrance whereas it is actually a soccer goal 118. In front of the soccer goal 118 is positioned the simulated goalkeeper. By the inclusion of a structural element 114 which has a entertaining or aesthetically pleasing appearance to children, they are encouraged to kick soccer goals past the simulated soccer goalkeeper.

Figure 12:
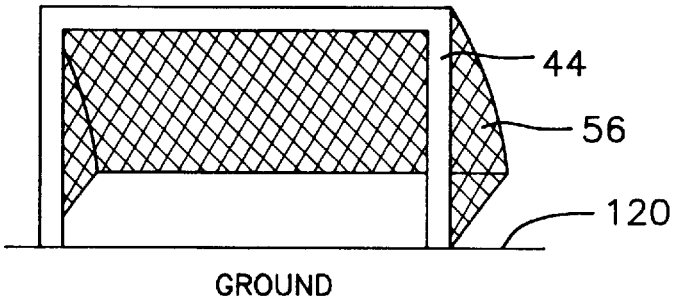
FIG. 12 is a front perspective view of a soccer goal which may be positioned within the simulated castle of FIG. 11.

FIG. 12 includes additional details, as in FIG. 2, of one example of a soccer goal 44 having net 56. The goal 44 is positioned on the level of the ground 120 within the opening 116 of the structural element 114 as shown in FIG. 11.

Figure 13:
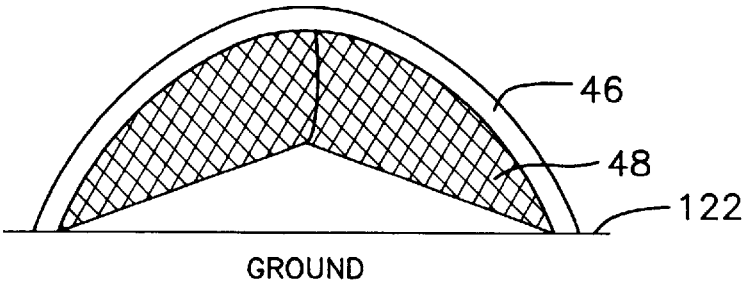
FIG. 13 is a front view of an alternative embodiment of a soccer goal which may be positioned within the opening of the simulated castle shown in FIG. 11.

As described with reference to FIG. 1, FIG. 13 illustrates an alternate soccer goal 46 having net structure 48. The goal 46 is positioned on the ground 122 in the opening 116 of the structural element 114 as shown in FIG. 11.

Figure 14:
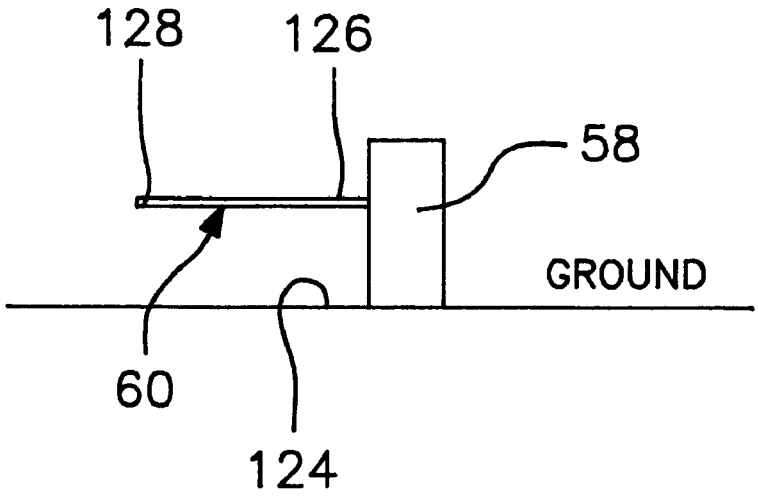
FIG. 14 is illustrative of a support stand having a supporting rod connected thereto at one end and having a free end for supporting a simulated soccer goalkeeper.

In FIG. 14, additional details of the base support 58, as shown in FIG. 2, is disclosed. The base support is of hollow cylindrical shape having weights in its interior and is supported by the ground 124. The base support is of sufficient weight such that one end 126 of support rod 60 extends perpendicular to the longitudinal axis of the base support such that the free end 128 is engageable in a hollow tube of greater diameter, with the hollow tube being mounted within the torso, arms or legs of a simulated soccer goalkeeper. Alternatively, as shown in FIG. 10, the support rod 110 which extends from the ground 104 to support the goalkeeper 102, can extend from the base support 58 so as to position the goalkeeper in any possible position.

Figure 15:
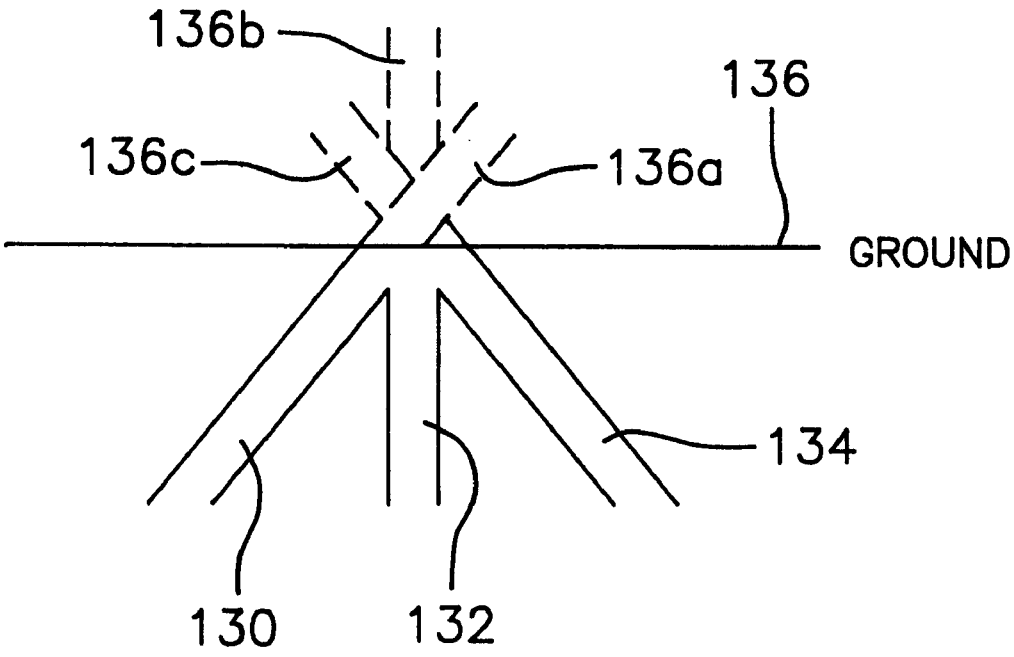
FIG. 15 is a partial cut-away view of a plurality of tubes located in the ground from which can project a supporting rod, as shown in dotted lines, for supporting a simulated soccer goalkeeper.

Alternatively, a plurality of tubes 130, 132, 134, can be located below ground level 136 in the field 32 as shown in FIG. 1. Extending from one of the tubes 130, 132, 134, will be a support rod 136*a*, 136*b* or 136*c* as shown in phantom lines in FIG. 15. The opposite end of the support rod 136*a*, 136*b* or 136*c* extends into a greater diameter tube located in the body of the simulated soccer goalkeeper. For example, in FIGS. 3, 5 and 9, a tube located within one of the feet of the goalkeeper located on the ground in these Figures, can include a hollow tube which receives a support rod extending from within tube 130, 132 or 134, dependent upon the positioning of the simulated soccer goalkeeper. In addition, as shown in FIG. 10, an L-shaped support rod 110 may extend from tube 132, in the position shown by support rod 136*b* so as to support a goalkeeper 102 above the ground.

In FIGS. 16 through 22, alternative methods of mounting a simulated soccer goalkeeper in front of a soccer goal are shown. These Figures illustrate a ceiling or wall mounted support rod system.

Figure 16:
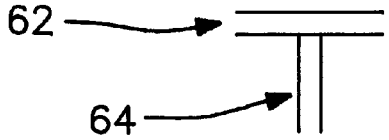
FIG. 16 illustrates a support track to be mounted on the ceiling of an indoor arena and having a slidably mounted support rod located having one end guided within the support track.
Figure 17:
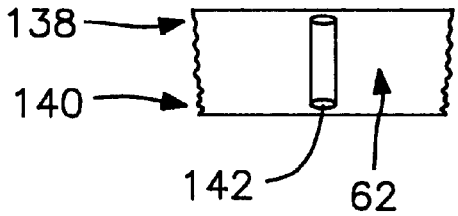
FIG. 17 is a bottom view of a guide bar located at the upper end of the support rod which is slidably mounted in two spaced arms of a C-shaped support track for slidably supporting the support rod as shown in FIG. 16.
Figure 18:
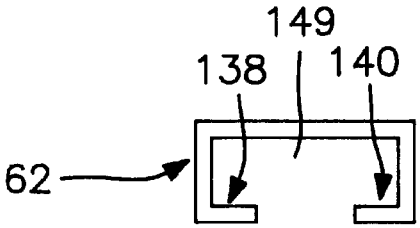
FIG. 18 is a cross-section of the C-shaped guide track shown in FIGS. 16 and 17.

For example, in FIGS. 16 through 18, a guide track 62 having support rod 64 extending therefrom, is shown, as is similarly shown in FIG. 2. The support rod is slidably mounted in the guide rail 62 for lateral movement of the goalkeeper. The guide rail 62 is C-shaped having arms 138, 140 which surround support bar 142 located at the upper end of support rod 64.

Support bar 142 and support rod 64 are secured to each other, preferably by welding, to form a T-shaped support mechanism for slidably mounting a simulated soccer goalkeeper in a guide track. It is understood that the opposite end of rod 64, from the end attached to the support bar 142, includes an angled rod portion or is directly insertable into a lesser diameter tube mounted in the simulated soccer goalkeeper. By the lateral movement of the support rod 64, the location of the goalkeeper can be varied. Of course, it is understood that the arms and legs of the goalkeeper can be positioned in any position simulative of the protective posture of the goalkeeper.

Figure 19:
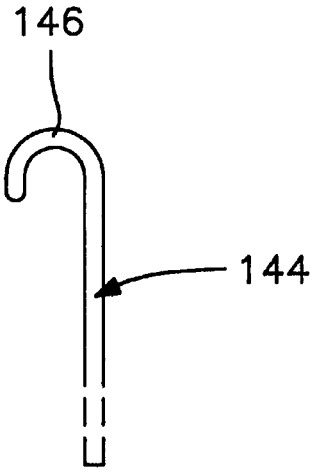
FIG. 19 of an alternative arrangement of a support rod which can be positioned on a guide bar supported in the guide track shown in FIGS. 16 through 18.
Figure 20:
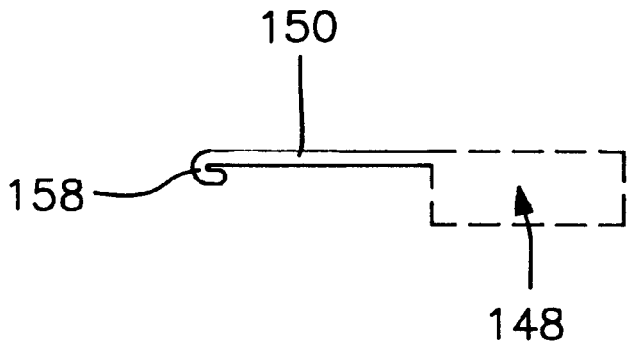
FIG. 20 is an end view of a support plate to be mounted on or within a wall above a soccer goal so as to support a simulated soccer goalkeeper.

Alternatively, a support rod may take the form of support rod 144 shown in FIG. 19. The support rod 144 includes a hooked end 146 which is adapted to hang on the support bar 142 which is slidably mounted in the gap 149 of the guide track 62.

In mounting the support system of the present invention in alternative locations, it is possible to use a plurality of metallic arms 148 (FIG. 20) supporting a hook-like metallic plate 150, from the walls of an arena. The spaced arms 148 can be mounted within a wall or externally of a sidewall.

Figure 21:
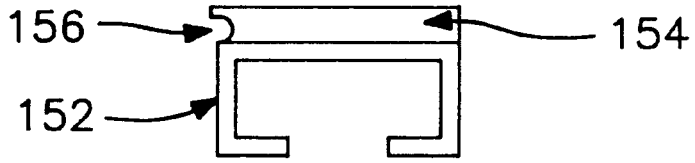
FIG. 21 is a cross-sectional view of a C-shaped guide rail which includes a plate slidably mounted in the support plate shown in FIG. 20.

Cooperating with the plate 150 is a C-shaped guide track 152, having plate 154 mounted on top of the guide track and including a mouth portion 156 which cooperates with a hooked portion 158 of the plate 150. It is thereby possible to suspend the guide track 152 from a wall as supported by spaced arms 148. A support bar and support rod, as shown in FIGS. 16 and 17 would then cooperate with the guide track 152 as shown in FIG. 21.

Figure 22:
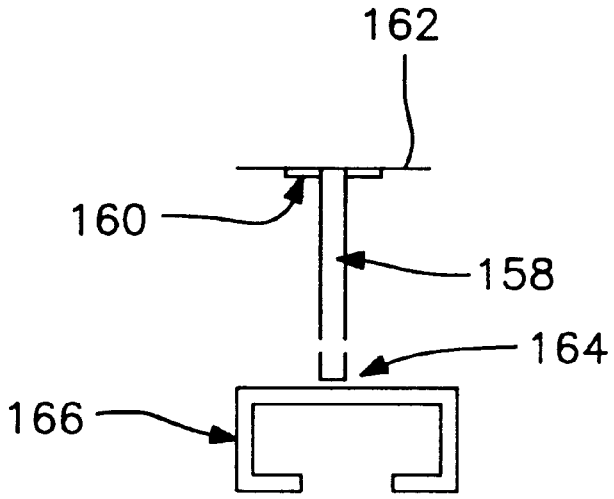
FIG. 22 is a support system for supporting a C-shaped guide rail from the ceiling of an indoor arena such that a simulated soccer goalkeeper may be slidable by a guide bar and support rod extending into the C-shaped guide rail.

Alternatively, a plurality of spaced supporting rods 158 can have one end mounted in a plate 160 mounted on the ceiling 162. An opposite end 164 of the support rods 158 could be secured or welded, at spaced locations, to an elongated C-shaped guide track 166. A support bar and support rod as shown with respect to 16 and 17, could cooperate with the guide track 166 as shown in FIG. 22 to laterally slide a simulated soccer goalkeeper in front of a soccer goal.

According to the present invention, a simulated soccer goalkeeper is positionable in front of a soccer goal into an infinite number of positions. In addition, with ceiling mounted or wall mounted support systems, the goalkeeper is laterally slidable across the opening of the goal.

The practice of an individual, and their improvement may be monitored and tracked by an appropriate marking system. The marking system may be entered on paper or computer program by an adult (parent) or supervisor so as to chart and/or statistically monitor the progress of an individual.

The foregoing description should be considered as illustrative only of the principles of the invention. Since numerous modifications and changes will readily occur to those skilled in the art, it is not desired to limit the invention to the exact construction and operation shown and described, and, accordingly, all suitable modifications and equivalents may be resorted to, falling within the scope of the invention.

I claim:

1. A soccer player practice system comprising:

a field of play, a structural form, an opening in said structural form at ground level of said field of play, a soccer goal located in said opening, a simulated soccer goalkeeper positioned in front of said soccer goal, said simulated soccer goalkeeper being movable into different positions, and a support device for positioning said soccer goalkeeper in front of said soccer goal, said support device cooperating with a tube in a foot of said soccer goalkeeper.

2. A soccer playing practice system as claimed in claim 1, wherein said field of play is in an indoor arena.

3. A soccer playing practice system as claimed in claim 2, wherein said indoor arena includes side walls and a ceiling.

4. A soccer playing practice system as claimed in claim 2, wherein said indoor arena includes a protected area for parents of a child practicing kicking of soccer goal shots past said soccer goalkeeper.

5. A soccer playing practice system as claimed in claim 1, wherein said structural form is in the shape of a castle projecting laterally from said opening and including a portion extending above said opening.

6. A soccer playing practice system as claimed in claim 2, wherein said soccer goalkeeper is suspended from a ceiling of said arena.

7. A soccer playing practice system as claimed in claim 6, wherein said soccer goalkeeper is suspended from a support rod.

8. A soccer playing practice system as claimed in claim 7, wherein said support rod is mounted on a support bar slidably mounted in a guide track.

9. A soccer playing practice system as claimed in claim 7, wherein said guide track is C-shaped.

10. A soccer playing practice system as claimed in claim 8, wherein said support rod includes a hooked end.

11. A soccer playing practice system comprising:

an indoor arena having a soccer playing field, a soccer goal located at one end of said soccer playing field, a soccer goalkeeper positioned in front of said soccer goal, and a support device for supporting said soccer goalkeeper in front of said soccer goal, said support device including a support rod having one end located in said soccer goalkeeper, said support device cooperating with a tube in a foot of said soccer goalkeeper.

12. A soccer playing practice system as claimed in claim 11, wherein an opposite end of said support rod is slidably mounted in a guide track.

13. A soccer playing practice system as claimed in claim 12, wherein said guide track is mounted on a ceiling of said arena.

14. A soccer playing practice system as claimed in claim 12, wherein said guide track is mounted on a wall of said arena.

15. A soccer playing practice system as claimed in claim 12, wherein said opposite end of said support rod is secured to a support bar in said guide track.

16. A soccer playing practice system as claimed in claim 12, wherein said guide track is C-shaped.

17. A soccer playing practice system as claimed in claim 11, wherein said arena includes artificial turf.

* * * * *